United States Patent [19]

Thomas et al.

[11] Patent Number: 4,932,551

[45] Date of Patent: Jun. 12, 1990

[54] COMPOSITE TANK ASSEMBLY

[75] Inventors: Larry D. Thomas; David L. Waltke, both of Beatrice, Nebr.

[73] Assignee: Hoover Group, Inc., Alpharetta, Ga.

[21] Appl. No.: 331,249

[22] Filed: Mar. 31, 1989

[51] Int. Cl.[5] ..... B65D 6/34

[52] U.S. Cl. ..... 220/85 P; 220/1.5; 220/71

[58] Field of Search ..... 220/83, 85 P, 85 SP, 220/5 A, 1.5, 71; 222/105, 185, 572, 573

[56] References Cited

U.S. PATENT DOCUMENTS

| | | | |
|---|---|---|---|
| 4,157,609 | 6/1979 | Schütz | 220/1.5 X |
| 4,489,847 | 12/1984 | Ames | 220/85 P X |
| 4,648,521 | 3/1987 | Thomas et al. | 220/1.5 |
| 4,660,733 | 4/1987 | Snyder et al. | 220/71 X |
| 4,795,057 | 1/1989 | Jungels et al. | 220/1.5 X |

*Primary Examiner*—Steven M. Pollard
*Attorney, Agent, or Firm*—Harness, Dickey & Pierce

[57] ABSTRACT

A plastic tank for storage and transport of liquids having a reinforcing sleeve for the discharge spout of the tank. The reinforcing sleeve comprises two identical generally C-shaped plate members which each have an overall circumferential length greater than one-half the circumference of the discharge spout to enable each plate member to be snap fit around the discharge spout and retained in place thereon. Each plate member has a V-shaped projection extending circumferentially from one end, and a corresponding recess at the other end to enable the plate members to interlock with one another and to axially self align on the discharge spout with the tip of the V-projection seating into the groove in the V-shaped recess.

12 Claims, 5 Drawing Sheets

COMPOSITE TANK ASSEMBLY

BACKGROUND AND SUMMARY OF THE INVENTION

This invention relates generally to tanks for storing and transporting bulk liquid and more particularly to a composite tank assembly consisting of a rigid frame structure and a large rotational or blow molded plastic bottle or tank confined within the frame.

Plastic tanks for bulk liquid storage and transport are conventionally designed with a discharge opening in the bottom of the tank or at the lower edge of a tank sidewall. The discharge opening generally includes a cylindrical spout extending perpendicular from the tank sidewall or bottom. The spout is threaded or otherwise configured to receive a discharge coupling or fitting. It is not uncommon for the connection between the discharge coupling and the discharge spout of the plastic tank to be a site for leakage due to any of a number of causes including deflection of the discharge spout caused by the clamping loads from the attachment of a discharge fitting to the spout.

One popular type of discharge fitting is a quick-connect coupling for use on rigid piping known as a KAMLOK coupling manufactured by the OPW Division of Dover Corp., Cincinnati, Ohio. This coupling is desirable because of the minimal effort required to connect and disconnect the coupling. However, because of the strength characteristics of the usual plastic tank discharge spout, the KAMLOCK coupling does not always provide a tight, leakproof connection with the discharge spout.

It is therefore an object of the present invention to provide a plastic tank with a reinforcing sleeve for the discharge spout of the tank to allow the use of KAMLOK couplings or other couplings requiring a mounting surface which is more rigid than the discharge spout of a plastic tank.

The plastic tank of the present invention includes a discharge spout having a reinforcing sleeve which is comprised of a pair of generally C-shaped plate members which are interlocked together, forming an annular sleeve over the tank discharge spout. The C-shaped plate members are made of a rigid plastic material, preferably glass filled polypropylene. The sleeve has an annular recessed groove about the outer surface of the sleeve to engage the cam arms of a KAMLOK coupler. The plate members are identical to each other and have a total length greater than one-half of the circumference of the discharge spout to enable each plate member to be snap fit over the discharge spout and retained in place on the spout.

One end of each plate member has a circumferentially directed V-shaped projection, while the other end of each plate member has a corresponding circumferential V-shaped recess. When the V-shaped projection of one member is seated into the recess of the other member, the two members form a complete circle covering the discharge spout. While the overall length of each plate member is greater than one-half the circumference of the discharge spout, the circumferential length of each plate member, measured at any given plane normal to the axis of the discharge spout, is equal to one-half the circumference of the discharge spout.

The angled side edges of the V-shaped projection and recess enable the two plate members to self align when they are assembled around the discharge spout. The point at the end of the V-shaped projection will slide into the groove of the V-shaped recess to ensure that the two members are aligned properly to form the annular reinforcing sleeve. A discharge coupling or fitting is then slipped over the reinforcing sleeve and discharge spout and the cam arms of the coupling are rotated to engage the annular groove in the outer surface of the sleeve to provide a tight, leakproof connection between the coupling and the spout.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
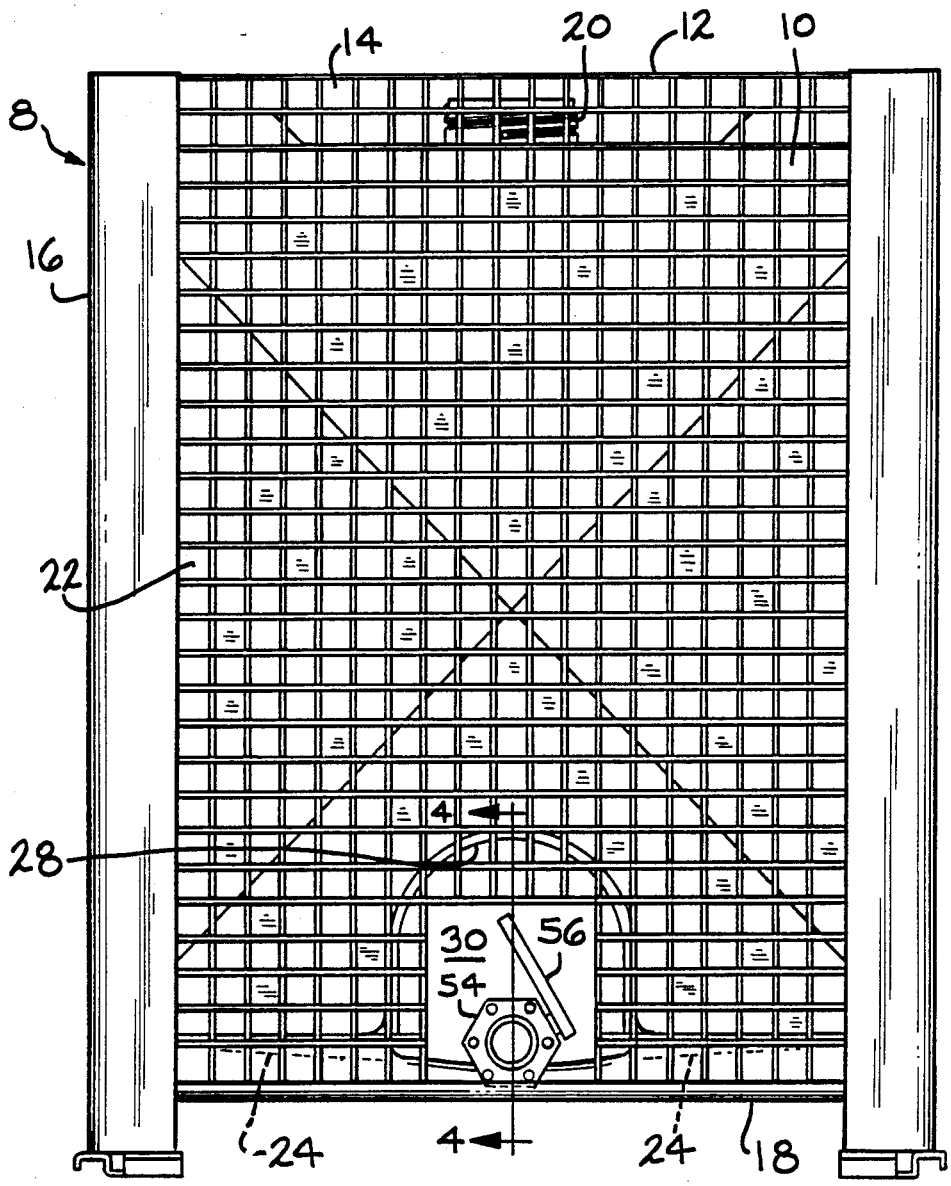
FIG. 1 is a front elevational view of the composite tank assembly of this invention.

The composite tank assembly of this invention, indicated generally at 8, is shown in FIG. 1 as consisting of a blow or rotational molded plastic tank or bottle 10 supported on and enclosed in a wire grid frame or support structure 12. The support structure 12 includes an upstanding sidewall comprised of four wire grid panels 14 attached at their vertical edges to steel support members 16 which form corners of the support structure and have legs extending below a bottom wall 18.

Figure 2:
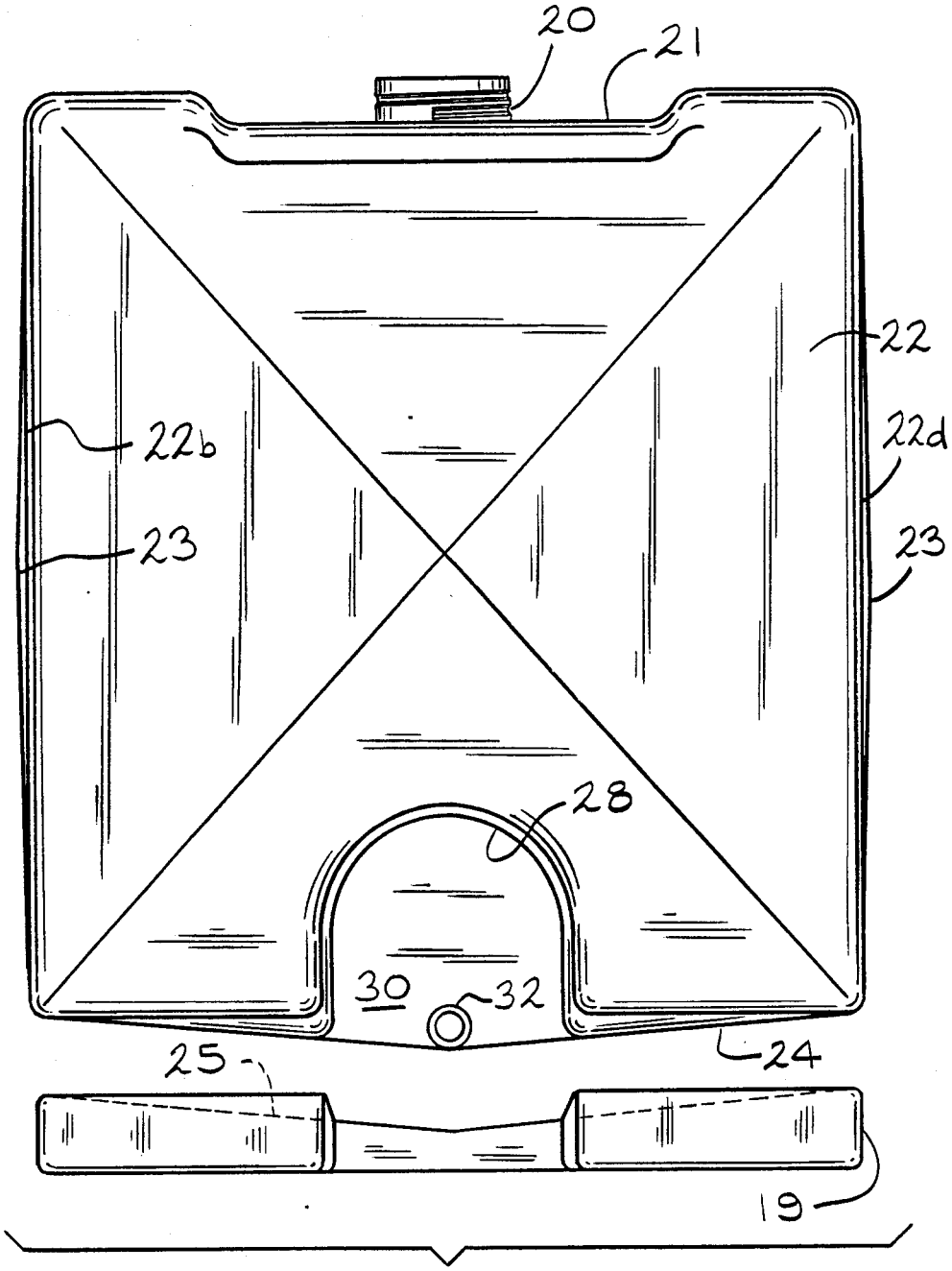
FIG. 2 is a front elevational view of the plastic tank of the composite tank assembly.
Figure 3:
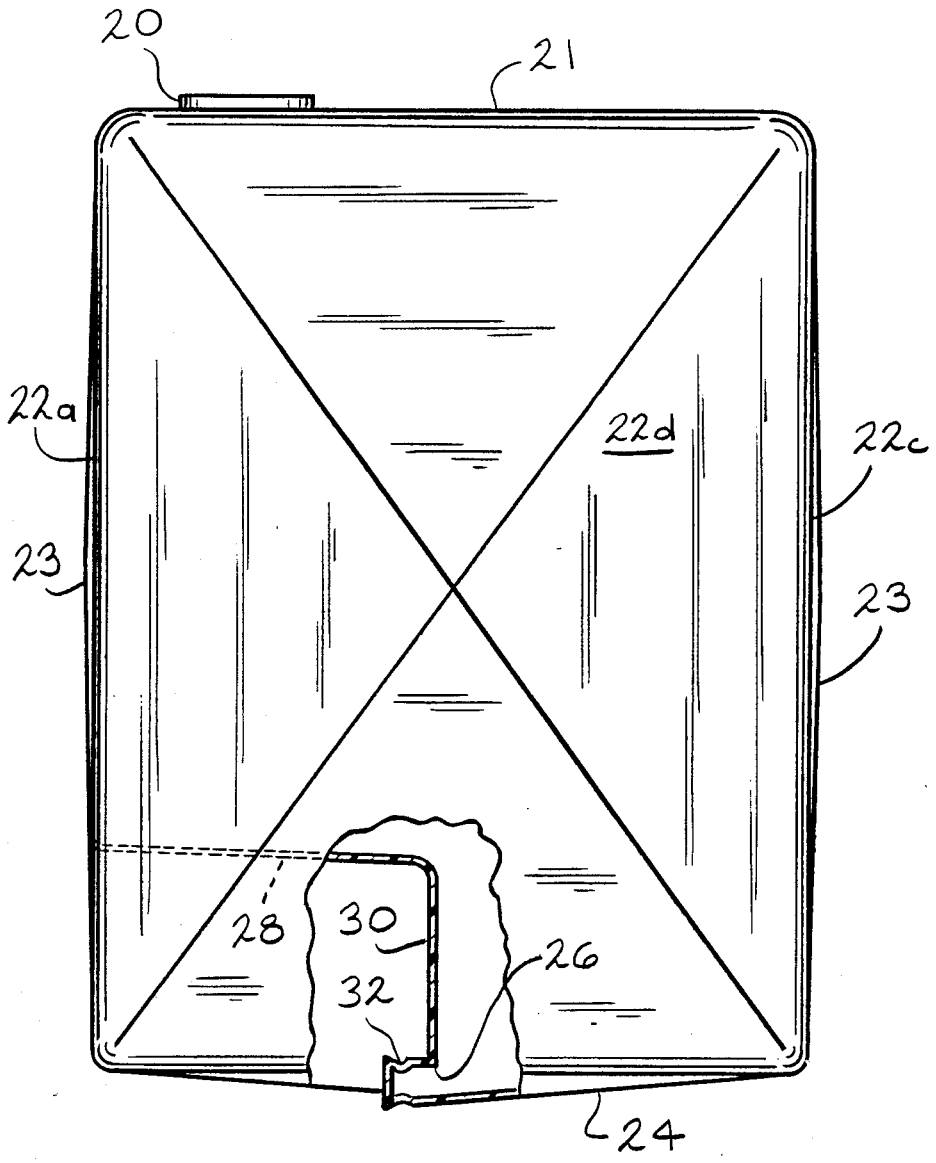
FIG. 3 is a side elevational view of the tank of FIG. 2 with a partial sectional view of the discharge spout portion of the tank.

The tank 10, shown in FIGS. 2 and 3, is blow molded of a plastic resin, such as polyethylene, and has a liquid capacity of approximately 350 gallons. Plastic tank 10 is of a relatively thin wall construction such that the support structure 12 is needed to support the tank 10 and maintain its shape. The tank 10 includes an opening 20 in the top wall 21 for receiving liquids for storage or transport in the plastic tank 10. Fill opening 20 is threaded for receipt of a suitable closure, not shown. Tank 10 has a vertical sidewall 22 having individual panels **22*a–d* at right angles to adjacent panels to form a rectangular tank. Each panel 22*a–d* includes a slight outward crown 23** at its center.

The tank bottom wall 24 is sloped downward toward the center to a discharge opening 26. The tank sidewall 22 has a recessed portion 28 extending into the tank from the sidewall 22 and surrounds the discharge opening 26. The recessed portion 28 enables the discharge opening 26 to be at a location interiorly of the support structure to protect the discharge opening and related coupling. The tank 10 is supported in the support structure 12 upon a polyethylene cushion 19, shown in FIG. 2. The cushion 19 has a sloped top surface 25 to maintain the bottom wall 24 in its sloped position.

The recessed portion 28 of the tank sidewall 22 includes a vertical back wall portion 30 which contains the discharge opening 26. The discharge opening 26 is surrounded by a cylindrical spout 32 which projects from the back wall 30 concentrically about an axis 34 normal to the back wall 30. The discharge spout 32 may deflect from the clamping load from a discharge coupling attached to the spout unless the spout is reinforced.

Figure 4:
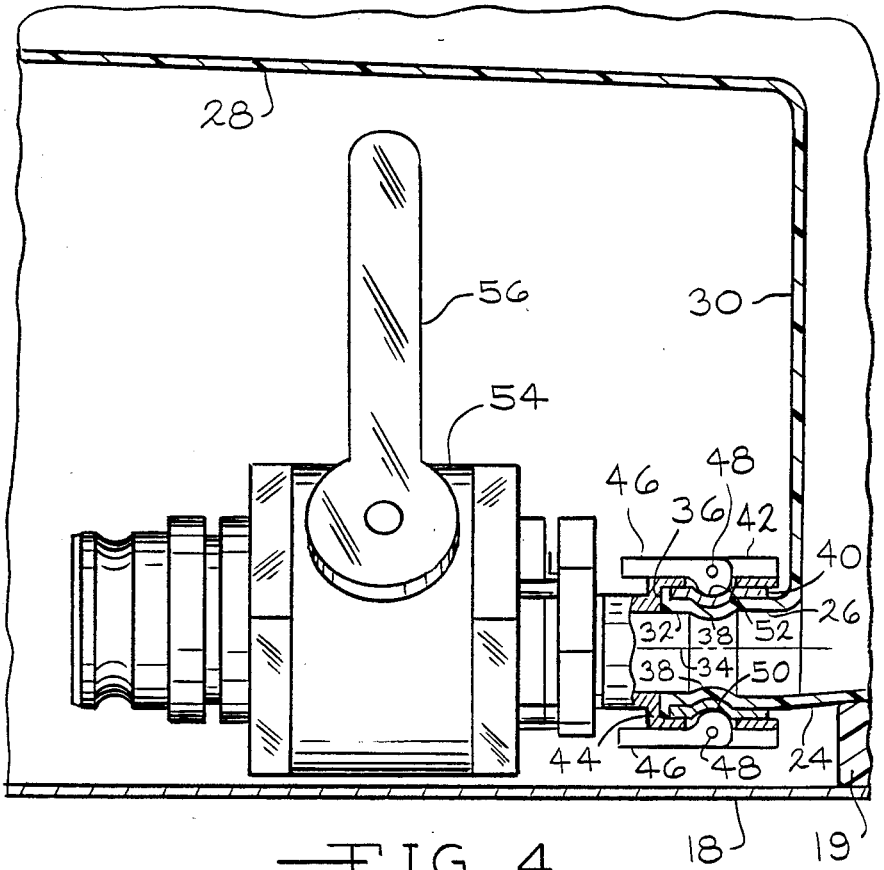
FIG. 4 is an enlarged fragmentary sectional view of the discharge spout portion of the tank assembly as seen from the line 4—4 of FIG. 1.

A reinforcing sleeve 40 is positioned around the discharge spout 32 to provide reinforcement of the discharge spout to accommodate the clamping loads from a discharge coupling. A KAMLOK coupling 42 is coupled to the discharge spout 32 and includes a body 44 with two cam arms 46 rotatably mounted to the body 44 about pins 48. The cam arms 46 include cam surfaces 50 which, in the coupled position shown in FIG. 4, are seated into an annular recess 52 in the outer surface of the reinforcing sleeve 40. In this position, the coupling body 44 is drawn tightly against the radial flange 36 at the end of the discharge spout 32. The reinforcing sleeve 40 is drawn tightly into engagement with the opposite side of the flange 36 thereby sandwiching the flange 36 between the coupling body 44 and the sleeve 40 to create a tight seal between the coupling 44 and flange 36. A valve body 54 is shown attached to the KAMLOK coupling 42 and includes a valve lever arm 56.

Figure 5:
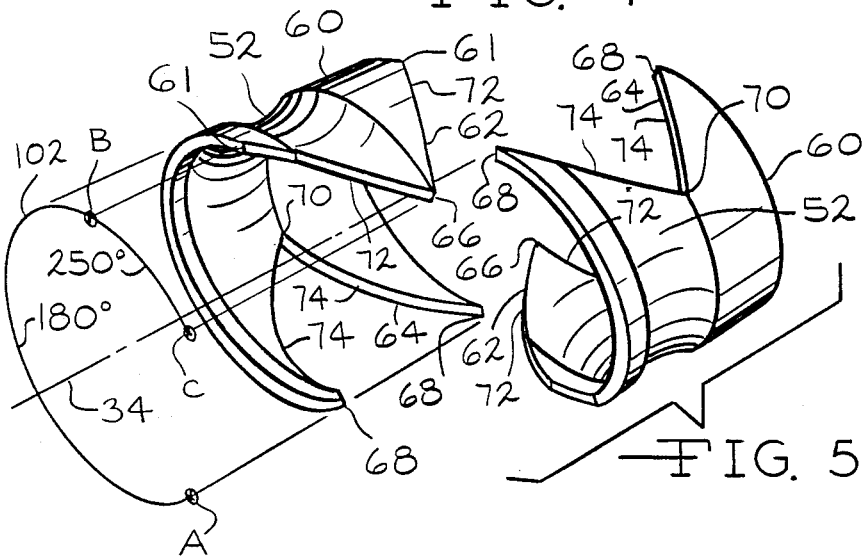
FIG. 5 is an exploded perspective view of the discharge spout reinforcing sleeve in the tank assembly.
Figure 6:
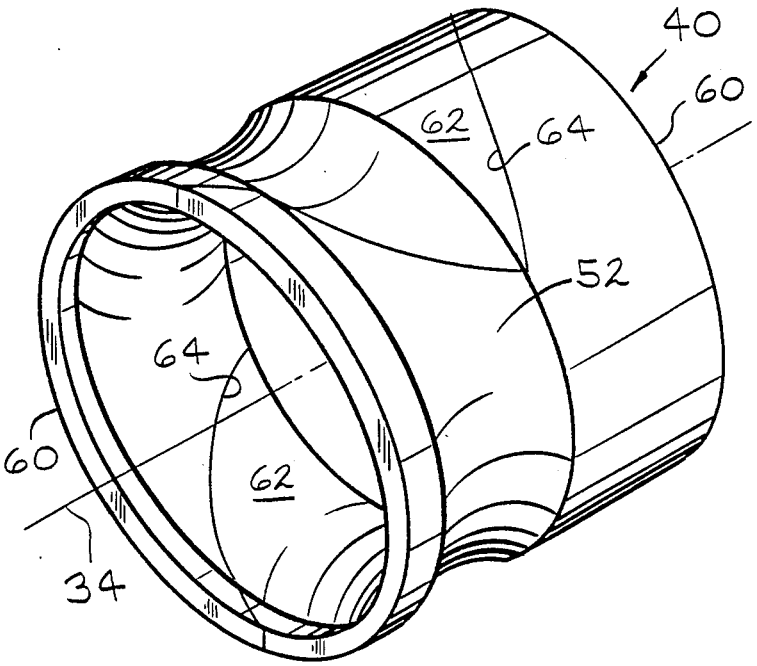
FIG. 6 is a perspective view of the reinforcing sleeve after assembly.

Referring now to FIGS. 5 and 6, the reinforcing sleeve 40 is constructed of two identical, generally C-shaped, plate members 60. The plate members have a circumferentially extending V-shaped projection 62 at one end, and a correspondingly shaped V-shaped recess 64 at the other end. The total length circumferentially of each plate member 60 from the tip 66 of the V-shaped projection to the ends 68 of the recess is greater than one-half of the circumference of the discharge spout 32. This is shown by the circular arc 102 in FIG. 5 which shows an angular distance between point A, corresponding to ends 68 of the V-shaped recess, and point C, corresponding to the tip 66 of the V-shaped projection, of 250° F.

The circumferential distance from the tip 66 of the V-shaped projection 62 to the groove 70 of the V-shaped recess 64 is equal to one-half of the circumference of the discharge spout 32. The circumferential distance from the end 61, the wide end of the V-shaped projection, to the ends 68 of the plate member is equal to one-half of the circumference of the discharge spout 32. This is also shown by the circular arc 102 showing the angular distance between points A and B as being 180° F.

Each plate member 60, by having an overall length greater than half the circumference of the spout, can be independently snap fit over the discharge spout 32 and retained on the spout. The straight angled sides 72 of the V-shaped projections 62, and the correspondingly straight angled sides 74 of the V-shaped recess enable the two plate members 60 to be axially self aligning about the discharge spout 32. When the two plate members are positioned about the discharge spout 32, regardless of where the tip 66 first contacts the recess 64, the edges of the projection will slide along the edges of the recess until the tip 66 seats into the groove 70. When fully seated relative to one another, the two plate members 60 are interlocked with one another and will not move axially along axis 34 relative to each other member. The projection and recess in the plate members can be of shapes other than a "V" to enable the plate members to be self retaining on the spout. However, the V-shape is preferred in that it also provides the self alignment as discussed above.

The sleeve 40 has an annular recessed grooved 52 which is seated into a corresponding annular groove 38 in the discharge spout 32. The groove 38 prevents axial movement of the reinforcing sleeve 40 prior to the KAMLOK coupling 42 being attached to the spout 32.

When the two identical plate members 60 are seated on the discharge spout 32, they form a continuous annular sleeve 40 to reinforce the discharge spout, enabling a KAMLOK coupling to be fitted onto the discharge spout and sealed tightly thereagainst. A reinforcing sleeve 40 is shown in FIG. 6 comprised of the two plate members 60 in an assembled relationship.

It is to be understood that the invention is not limited to the exact construction as described above, but that various changes and modifications may be made without departing from the spirit and scope of the invention as defined in the following claims.

What is claimed is:

1. In a tank assembly for liquid storage and transport comprising an upright rigid support structure having a sidewall with an access opening adjacent the lower end, a unitary plastic tank supported in said frame having a sidewall and a bottom wall, one of said tank walls be provided with a discharge opening accessible through said access opening, and said one wall having a generally cylindrical spout extending outwardly therefrom and communicating with said discharge opening, an annular reinforcing sleeve disposed in a covering relation with said cylindrical spout and comprising a pair of substantially C-shaped plate members interlocked together and extending about said cylindrical spout in a substantially coaxial relation with said spout, each of said members having a total length greater than one-half the circumference of said cylindrical spout to enable said plate members to be snap fit over said cylindrical spout to retain said plate members on said spout, and each plate member having a circumferential length about any point on said axis of approximately one-half the circumference of said spout so that when a pair of plate members are interlocked about said cylindrical spout they form said annular reinforcing sleeve covering said spout.

2. The tank assembly according to claim 1 wherein said coacting means comprises a shaped projection extending circumferentially from one end of each of said plate members and a correspondingly shaped recess in the other end of each of said plate members so that said projection on said one end of one plate member engages said recess on said other end of the other plate member when said members are positioned over said cylindrical spout symmetrically about said axis.

3. The tank assembly according to claim 3 wherein said plate members are made of a plastic material.

4. The tank assembly according to claim 3 wherein said plate members are made of glass filled polypropylene.

5. The tank assembly according to claim 2 wherein said shaped projection is V-shaped, and said recess has a corresponding V-shape to enable the plate members to self align as the plate members are positioned about said cylindrical spout with the tip of the V-shaped projection seated into the groove of the V-shaped recess.

6. The tank assembly according to claim 2 wherein said cylindrical spout terminates in an annular flange projecting radially outwardly from said cylindrical spout against which said plate members abut to prevent said plate members from sliding axially off the cylindrical spout.

7. The tank assembly according to claim 6 wherein said reinforcing sleeve has a radially inwardly directed annular recess for operative association with a mating removable discharge coupling for directing liquid discharged from said tank through said discharge opening.

8. A bulk liquid storage and transport container assembly, comprising:

A support structure having a vertical sidewall, a bottom wall and a plurality of leg members extending downwardly from said bottom wall;

a plastic tank supported within said support structure having at least one sidewall and a bottom wall, said sidewall including a recessed portion with a generally vertical back wall, a discharge opening through said back wall with a cylindrical discharge spout extending outwardly from said back wall and communicating with said discharge opening, said spout being concentric about an axis normal to said back wall and extending centrally through said opening;

a support cushion having a sloped upper surface positioned between said support structure bottom wall and said plastic tank bottom wall, said sloped upper surface maintaining the bottom wall of said tank in a position sloped downwardly toward said discharge opening;

a reinforcing sleeve disposed in a covering relationship with said spout and comprising a pair of identical C-shaped plate members interlocked together, each of said plate members having a total length greater than one-half the circumference of said discharge spout to enable each of said plate members to be snap fit about said spout, each of said plate members having retaining means operatively engaging said spout to retain said plate members in engagement with said spout, said plate members further having means for axially aligning one plate member with the other plate member about said spout, said sleeve reinforcing said spout to enable leak tight attachment of a discharge fitting to said spout.

9. The assembly according to claim 8 wherein said axially aligning means comprises a shaped projection extending circumferentially from one end of each of said plate members and a correspondingly shaped recess in the other end of each of said plate members so that said projection of one plate member engages said recess on the other plate member when said members are positioned over said discharge spout concentric about said axis.

10. The assembly according to claim 9 wherein said projection has a straight sided V-shape and said recess has a corresponding V-shape to enable the sides of the projection to slide against the sides of the recess to axially align said members as the projection of one plate member is seated into the recess of the other plate member.

11. The assembly according to claim 9 wherein said plate members are made of a thermoplastic material.

12. The assembly according to claim 11 wherein said plate members are made of glass filled polypropylene.

* * * * *

UNITED STATES PATENT AND TRADEMARK OFFICE

CERTIFICATE OF CORRECTION

PATENT NO. : 4,932,551

DATED : June 12, 1990

INVENTOR(S) : Larry D. Thomas and David L. Waltke

It is certified that error appears in the above-identified patent and that said Letters Patent is hereby corrected as shown below:

Column 4, line 27, claim 1, "be" should read --being--.

Column 5, line 12, claim 8, "A" should read --a--.

Signed and Sealed this

Eighteenth Day of February, 1992

*Attest:*

HARRY F. MANBECK, JR.

*Attesting Officer*

*Commissioner of Patents and Trademarks*